United States Patent [19]

Jesernig et al.

[11] 4,377,281

[45] Mar. 22, 1983

[54] PIVOTED WEIGHT SUPPORTED FRAME EXERCISE DEVICE

[76] Inventors: Rudolph W. Jesernig, 2947 E. 10th Ave., Kennewick, Wash. 99336; Anthony Tenisci, 815 California St., Pullman, Wash. 99163

[21] Appl. No.: 237,475

[22] Filed: Feb. 23, 1981

[51] Int. Cl.[3] ..... A63B 21/06

[52] U.S. Cl. ..... 272/120; 272/128

[58] Field of Search ..... 272/117, 120, 128, 144, 272/DIG. 4, 116, 93, 123, 122, 85–92; 297/273–282; 128/25 R, 25 B

[56] References Cited

U.S. PATENT DOCUMENTS

| | | | |
|---|---|---|---|
| 1,659,223 | 2/1928 | Swanson | 272/85 |
| 2,682,401 | 6/1954 | Curtis | 272/120 |
| 2,729,271 | 1/1956 | Hayes | 272/120 |
| 3,858,873 | 1/1975 | Jones | 272/117 |

*Primary Examiner*—Richard C. Pinkham
*Assistant Examiner*—William R. Browne
*Attorney, Agent, or Firm*—Wells, St. John & Roberts

[57] ABSTRACT

A device for exercising leg muscles. The device includes a seat and backrest arrangement mounted near the bottom end of an upright suspended frame. The opposite upper end of the frame is mounted to a support for free pivotal movement about a horizontal axis. Overall weight of the entire unit can be varied by adding to or removing weights from a bar below the seat. Resistance to pivotal movement is thereby selectively varied. Legs are exercised by a user seated at the device thrusting rearwardly with his or her legs against a stationary surface. Repeated thrusting leg motions cause a pendulum motion resisted by the overall unit weight. At an extreme outward end of the motion, the user's legs may leave contact with the stationary surface and can relax until the unit pivots back to the start position.

5 Claims, 3 Drawing Figures

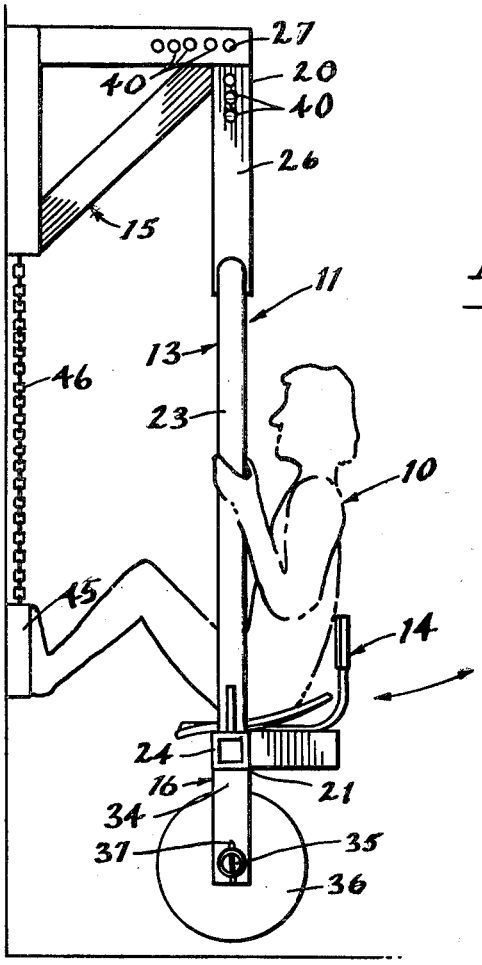
FIG 1
FIG 2
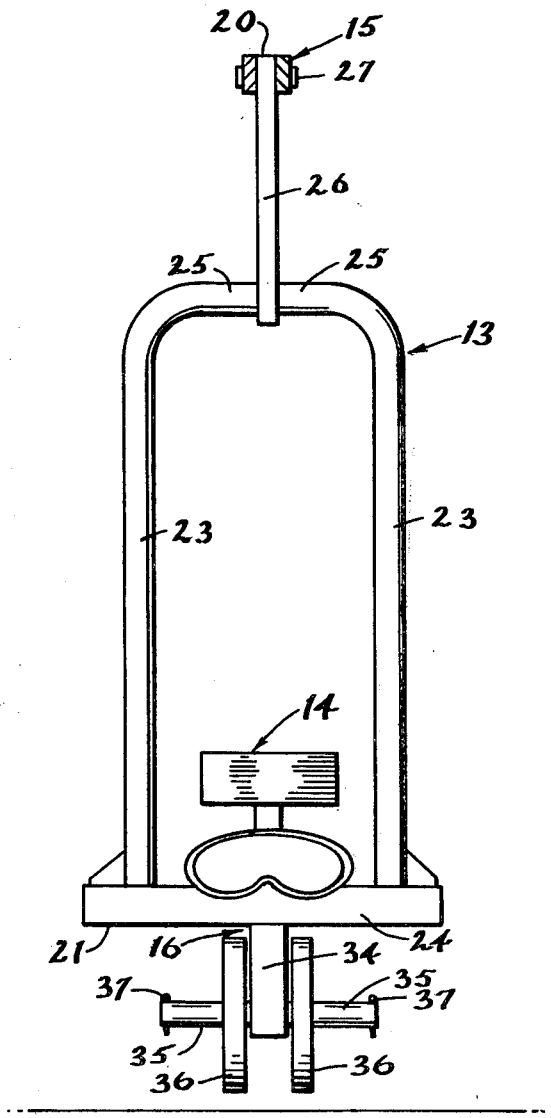
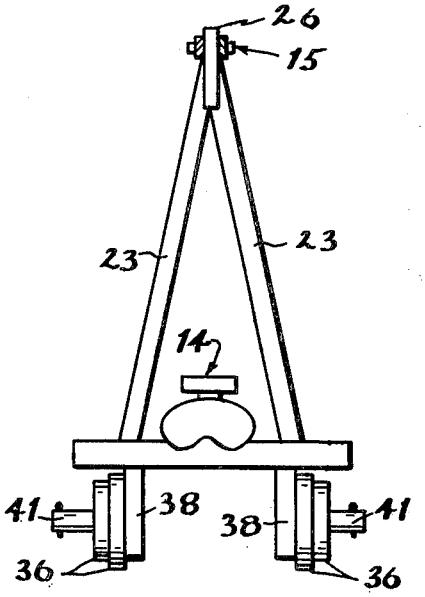
FIG 3

PIVOTED WEIGHT SUPPORTED FRAME EXERCISE DEVICE

BACKGROUND OF THE INVENTION

The present invention relates generally to exercising devices and more particularly to devices for exercising leg muscles.

The standard manner used to exercise leg muscles is to lift heavy barbells held on the shoulders during deep "squat" movements. The movement upward from the deep squat position is very slow. This exercise builds leg muscles, but does not promote quickness. It also results in considerable strain being placed on the back and spine. Many injuries have been reported as a result of such exercise programs. It is relatively inefficient since the weight against which the user must work is situated on the shoulders at a substantial distance from the area of the body (the legs) being exercised.

An alternative to the "squat" apparatus described above is the relatively recent use of "sitdown" leg exercisers in which the user sits on a stationary seat and places his or her feet on horizontally spaced pedals. The user pushes to shift the pedals horizontally until his or her legs become straight. The pedals are then allowed to return to the original position by bending the knees and allowing the feet to move back toward the torso. The user pushes against the pedals with his or her back braced against a backrest of the seat. Back strain is therefore avoided.

A difficulty remains in exercising the leg muscles to promote both strength and quickness. To do this, there must be some form of quick "springing" action available to the legs. This can be done by jumping or, theoretically, by pushing the pedals with such force that they leave engagement with the feet when the legs become straight and locked. This is very impractical and extremely hazardous due to the returning force of the pedals. If the feet are not correctly positioned, the pedals will return and strike against the upper part of the user's legs. This can result in severe injury.

U.S. Pat. No. 2,783,045 granted to L. R. Bosch, in 1957 discloses a push-pull exerciser in which the user rests against an inclined table to perform deep "squat" exercises. Some improvement in safety is made by keeping the back straight and resting against a flat guide surface. However, the weight must still rest on the shoulders of the user. The problem of developing quickness along with leg strength remains unsolved.

A toy seesaw set is disclosed in U.S. Pat. No. 3,420,522 to Elliot, granted in 1969. Elliot shows playground equipment with a single seat at the end of a cantilevered arm. The other arm end is supported at a pivot and a spring which yieldably resists movement of the seat in a downward "seesaw" arc. The Elliot device is intended to reduce forces required to be applied through the rider's legs and is designed more for amusement than for exercise.

The present device eliminates the dangers associated with prior "squat" type exercising, and the failure of sitting type apparatus to develop quickness of thrust in athlete's legs. The present device makes use of a suspended frame-mounted seat that will pivot freely about an elevated horizontal axis. Weights can be added to or removed from the frame, thereby selectively adjusting resistance to pivotal motion about the axis. The user can sit on the seat and push rearwardly against a wall or other stationary surface, causing the frame to pivot freely outward in the opposite direction. The user's legs can relax as the frame pivots outwardly from the wall, then flex again as the frame returns toward the wall. Quickness of leg thrust and leg strength are both developed through use of the present apparatus without accompanying danger of back strain or spinal damage.

BRIEF DESCRIPTION OF THE DRAWINGS

FIG. 1 is a side elevational view;

FIG. 2 is a front side view; and

FIG. 3 shows a Y-shaped frame for supporting a seat and removable weights.

DETAILED DESCRIPTION OF A PREFERRED EMBODIMENT

FIG. 1 shows a user 10 seated on the present device, which is generally shown at 11. The device 11 is generally made up of an upright frame 13 mounting a seat and backrest arrangement 14 at a lower end thereof. The user 10 may be seated along the frame substantially in the position indicated by FIG. 1. A bracket means 15 is provided to be mounted to a support structure such as a wall 12, a ceiling or other appropriate support structure. It suspends the frame 13 and attached elements for free pivotal movement about a horizontal axis. The degree of freedom of movement may be selectively modified by adding or removing weight at a weight mounting bar means 16 situated below the seat and bracket assembly 14.

The frame 13 is shown in particular detail in FIG. 2. An alternate form is shown by FIG. 3. Back forms include a top end 20 and a bottom end 21 that are spaced apart elevationally when the frame is mounted to the bracket means 15 and suspended above a floor or other support surface. The frame 13 of FIG. 2 is formed partially in an inverted U-shape, having parallel spaced upright legs 23. The legs 23 are joined at bottom ends by a cross member 24. The upper closed end of the inverted U-shaped configuration is defined by horizontal sections 25 of the legs. FIG. 3 shows the frame in an inverted "Y" shape with legs 23 diverging from a rigid upright bar 26.

The bar 26 on both forms is substantially centered between the legs 23 and is preferably rigidly fixed to them. The entire frame is therefore rigid along its length.

The upper end of the bar 26 has a bearing opening to receive the pivot pin 27. This pin extends through the bar 26 and complementary apertures provided in the bracket means 15. The pin 27b defines a horizontal axis about which the entire frame 13, seat and backrest assembly 14, and weight mounting bar 16 will pivot in the manner of a pendulum. It is noted that various other arrangements may be made for pivotably suspending the inverted U-shaped frame from the bracket means. A flexible connector used in place of the rigid upright bar 26 has operated marginally. However, the bar arrangement shown is preferred due to increased control provided through the rigid assembly.

The bracket means 15 as briefly described above can be mounted to any number of support structures including the wall or ceiling. Additionally, it is conceivable that the bracket could be provided in the form of an "A-frame" (not shown) mounted to a floor or ground support with the frame 13 suspended from a beam or other elevated support device. The configuration of the bracket means 15 may therefore vary substantially to match the nature of the exercise facilities and support requirements. It is also pointed out that selective adjustment can be provided along the frame and bracket means to facilitate height adjustment of the frame and horizontal adjustment toward or away from the surface 12. This can be done by providing additional pin receiving apertures (40) spaced along the length of the bar 26 and the bracket means 15.

The mounting bar means 16 is situated on the frame adjacent the seat and is adapted to releasably receive weights to correspondingly adjust the natural resistance to pivotal motion of the frame beyond the upright orientation shown in FIG. 1. The mounting bar assembly 16 of the FIG. 2 version includes an upright post 34 that may be vertically aligned with or rearward of the bar 26 (centered between the legs 23). The post 34 extends downwardly below the seat and backrest arrangement 14 to mount a transverse horizontal bar 35.

The FIG. 3 version shows two posts 38 affixed to the frame and extending downwardly from opposite sides of the seat. Weight mounting bars 41 project horizontally to opposite sides of the seat to releasably receive weights. The posts 38 define a clear open space below the seat. The user's feet cannot therefore become "pinched" between the weights and the support (wall).

The bars 35 and 41 are preferably circular with a diameter corresponding to the bar receiving apertures of standard weight plates 36 typically used in weight training. Retainer pins 37 are provided at outward ends of the bar 35 to hold the weight plates in position. The bar 35 extends equally on opposite sides of the post 34 in order to maintain balance of the unit. Weight plates of equal weight should be placed on opposite sides of the post 34 in order to maintain balance.

Research has indicated that a "foot block" or "kick block" 45 suspended from the bracket 15 is desirable to allow exercise of various muscles of the lower extremities. The kick block may consist of an elongated block held in a selected horizontal position by adjustable chains or cables 46. The kick block rests against the wall and projects outwardly therefrom to present a contact surface for the feet of the user. The block 45 can be selectively raised or lowered on the chains or cables 46 to vary the point of contact with the user's feet. The block can be raised to allow "toe only" contact or lowered to provide "heel only" contact. This therefore allows exercising of all the different muscles in the leg and hip area.

In order to use the present device, one must sit on the seat with the back in contact with the backrest assembly 14. It can be noted in FIG. 1 that the torso of the seated user is situated rearwardly of the frame arrangement. This allows the user to comfortably grip the legs 23 at approximately shoulder height. The user can therefore hold the assembly steady and maintain a comfortable arm position.

The user's back is braced horizontally against the backrest of the assembly 14. It is noted that adjustment features (not shown) can be provided to selectively vary the position of the backrest as typically provided with similar backrest arrangement for chairs. Such adjustment features are well known.

The seat and backrest arrangement substantially center the weight of the user along the frame in a plane aligned with the bar 26 to prevent binding along the pin 27. The only significant resistance to movement about the horizontal axis, therefore, is the overall weight of the user and device 11.

Exercising is commenced by putting the feet firmly against a wall 12 or the kick block 45 with knees bent as shown in FIG. 1. The user then thrusts rearwardly (to the right in FIG. 1) against the pendulous weight of the user and exercise device. The rearward thrust will cause the frame to pivot rearwardly about the axis of the pin 27.

The amount of weight suspended on the weight mounting bar 16 is carefully selected so that the user can readily thrust the unit rearwardly clear of the support surface 12. The user's feet will therefore leave engagement with the support surface. During this time the leg muscles can relax.

When the energy of the thrust is expended, the unit will pivot back toward the surface 12. The user can then brace his or her legs for impact against the surface. Following impact, the legs may bend at the knees with muscles absorbing the energy of the forward swinging motion. The outward thrust can then be repeated. The process can be repeated for an extended time during which leg muscles and quickness are progressively developed and improved.

The above description and attached drawings have been given by way of example to set forth a preferred form of the present invention.

Having thus described our invention, what we claim is:

1. An exercising device for movably supporting a user adjacent a stationary upright surface of wall, against which the user can engage the feet and thrust rearwardly with the legs to swing the device away from the surface or wall, the exercising device comprising:

a frame having a top end and a bottom end;

means freely suspending the frame from its top end for swinging movement about a stationary transverse horizontal axis;

a user's seat and backrest fixed to the frame adjacent its bottom end and adapted to receive and support a user;

mounting means fixed to the frame below the seat for releasably fixing auxillary weights to the frame to thereby vary the physical force necessary to be exerted by a user positioned on the seat to pivot said frame about said axis.

2. The exercise device of claim 1 wherein the mounting means is a rigid bar located elevationally beneath the seat.

3. The exercise device of claim 1 wherein the frame has an inverted "U" shape with a horizontal cross member extending between open legs at the bottom end of the frame; and said seat and backrest being fixed to the cross member at positions transversely centered between the open legs of the frame.

4. The exercise device of claim 1 wherein the frame includes parallel transversely spaced legs straddling the seat and backrest.

5. The exercise device of claim 1 further comprising:

kick block means for receiving the force of a user's said block means adjustably suspended from the means freely suspending the frame from its top end, said kick block means being adapted to rest against an adjacent vertical stationary surface or wall.

* * * * *